US009302174B2

(12) United States Patent
Fuhrmeister et al.

(10) Patent No.: US 9,302,174 B2
(45) Date of Patent: Apr. 5, 2016

(54) TRANSFORMABLE OBSTACLE ASSEMBLY

(71) Applicants: Cory Fuhrmeister, Johns Island, SC (US); Carl Borgstrom, Johns Island, SC (US)

(72) Inventors: Cory Fuhrmeister, Johns Island, SC (US); Carl Borgstrom, Johns Island, SC (US)

( * ) Notice: Subject to any disclaimer, the term of this patent is extended or adjusted under 35 U.S.C. 154(b) by 0 days.

(21) Appl. No.: 14/710,249

(22) Filed: May 12, 2015

(65) Prior Publication Data

US 2015/0321075 A1 Nov. 12, 2015

Related U.S. Application Data

(60) Provisional application No. 61/991,926, filed on May 12, 2014.

(51) Int. Cl.

| | |
|---|---|
| ***A63C 19/10*** | (2006.01) |
| ***A63C 19/00*** | (2006.01) |
| ***A63B 69/00*** | (2006.01) |
| ***A63B 69/16*** | (2006.01) |
| ***A63B 69/18*** | (2006.01) |
| ***A63C 17/00*** | (2006.01) |
| *A63G 19/00* | (2006.01) |

(52) U.S. Cl.

CPC ..... *A63C 19/00* (2013.01); *A63B 69/0022* (2013.01); *A63B 69/16* (2013.01); *A63B 69/18* (2013.01); *A63C 17/0006* (2013.01); *A63C 2201/02* (2013.01)

(58) Field of Classification Search

CPC ..... A63C 19/00; A63C 19/10; A63C 19/04; A63G 21/00

USPC ..... 472/88–91; 108/129, 132, 147.21; 14/69.5

See application file for complete search history.

(56) References Cited

U.S. PATENT DOCUMENTS

| | | | | |
|---|---|---|---|---|
| 5,718,412 | A * | 2/1998 | Levanas | A63C 19/10 256/1 |
| 7,662,044 | B2 | 2/2010 | Corne et al. | |
| 8,690,695 | B1 * | 4/2014 | Pittman | A63C 19/08 108/147.21 |
| 2010/0311510 | A1 * | 12/2010 | Dickson | A63C 19/10 472/89 |

* cited by examiner

*Primary Examiner* — Kien Nguyen

(74) *Attorney, Agent, or Firm* — Leyendecker & Lemire, LLC

(57) ABSTRACT

A transformable obstacle assembly is described. Embodiments of the transformable obstacle assembly include a dual rail structure and a pair of support structures. Typically, the dual rail structure can include a first rail, a second rail, a plurality of ribs, and a pair of panels. The plurality of ribs can be implemented to couple the first rail to the second rail. To elevate the dual rail structure of the ground, the pair of support structures can be coupled to opposite ends of the dual rail structure. In one embodiment, a height of the support structures can be altered to raise and lower the dual rail structure. Typically, the dual rail structure can be implemented in either a horizontal orientation or a vertical orientation.

21 Claims, 16 Drawing Sheets

TRANSFORMABLE OBSTACLE ASSEMBLY

CROSS-REFERENCE TO RELATED APPLICATION

This application claims the benefit of U.S. Provisional Application No. 61/991,926, filed May 12, 2014.

BACKGROUND

Skateboarders, BMX riders, aggressive inline skaters, snowboarders, skiers, and scooter riders all use stationary obstacles to perform tricks on. Each of these sports includes certain tricks called grinds. A grind refers to sliding a board, bicycle, etc. across a section of the stationary obstacle. Typically, stationary obstacles will include a railing, ledge, or other slick surface from which to grind. Rails can come in different sizes and shapes. Large flat surfaces on which grinds are performed on sides of the stationary obstacles are referred to as ledges or boxes.

Skateboarders require a smooth, large area to be able to ride effectively. Parking lots and sidewalks provide the necessary consistency for most riders. Since skateboarders are often limited by their location, there may be very few places to ride and/or set up obstacles.

As such, a transformable obstacle providing a wide range of challenges is needed. Such a transformable obstacle can help a rider progress since more options are available, and the rider will not grow tired of continuously riding a single obstacle.

DETAILED DESCRIPTION

Figure 1A:
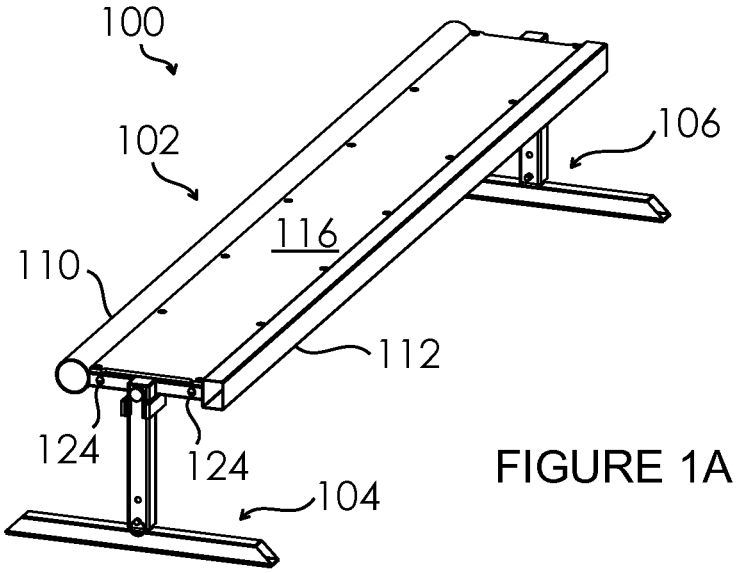
FIGS. 1A-1B are perspective views of a transformable obstacle assembly according to one embodiment of the present invention.

Embodiments of the present invention include a transformable obstacle assembly for use by extreme sport athletes. Typically, the transformable obstacle assembly can include a dual rail structure and a pair of support structures. The dual rail structure can include, but is not limited to, a first rail, a second rail, a plurality of ribs, a first panel, and a second panel. The pair of support structures can each include a T-shaped frame and a sleeve. The sleeve can include a pair of flanges located near an upper portion of the sleeve to engage with the dual rail structure.

The plurality of ribs can be implemented to connect the first rail to the second rail. Generally, the first rail and the second rail can be connected in parallel. In one embodiment, the plurality of ribs can be steel tubes directly coupled to the first rail and to the second rail via ends of the steel tubes. Typically, the first panel and the second panel can be made from a rigid material having a slick surface. For instance, the first panel and the second panel can be made from polyvinyl chloride. It is to be appreciated that other rigid materials having slick surfaces can be implemented without exceeding a scope of the present invention.

The first panel and the second panel can be implemented to offer different trick options for extreme sports athletes. For instance, an athlete may ride or execute a manual (e.g., a trick in which one or more wheel(s) are balanced off the ground while riding) along a center of one of the panels without grinding the rails. Typically, grinds can pose different challenges for riders depending on geometric characteristics of the grind surface.

In one embodiment, the first rail and the second rail can have different shapes. For instance, the first rail can have a tubular structure and the second rail can have a rectangular tube structure. In another instance, the first rail and the second rail can have the same shape. It is to be appreciated that the first rail and the second rail can have a variety of shapes and sizes. Generally, the first rail and the second rail can be the same length.

Embodiments of the present invention include a dual rail structure having curved rails. Typically, the curved dual rail structure can be implemented similar to the previously described dual rail structure. In one embodiment, the plurality of ribs can be coupled to a convex side of a first rail and a concave side of a second rail. In another embodiment, the plurality of ribs can be coupled to side's located approximately 90 degrees from the convex or concave sides of the rails.

Embodiments of the present invention further include a transformable obstacle assembly including a quad rail structure. Typically, the quad rail structure can have a square or rectangular cross-section. Support structures similar to the previously described support structures can be implemented to elevate the quad rail structure.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

A First Embodiment of a Transformable Obstacle Assembly

Referring to FIGS. 1A-6B, detailed diagrams of an embodiment 100 showing a transformable obstacle assembly is illustrated. Generally, the obstacle assembly 100 can be implemented in a park adapted for extreme sports. For instance, the obstacle assembly can be implemented in a skate park. In another instance, the obstacle assembly can be implemented in a snowboard/ski park. It is to be appreciated that the obstacle assembly can be implemented in any location conducive to a particular extreme sport. For instance, the obstacle assembly can be implemented in a driveway or a street.

Figure 1B:
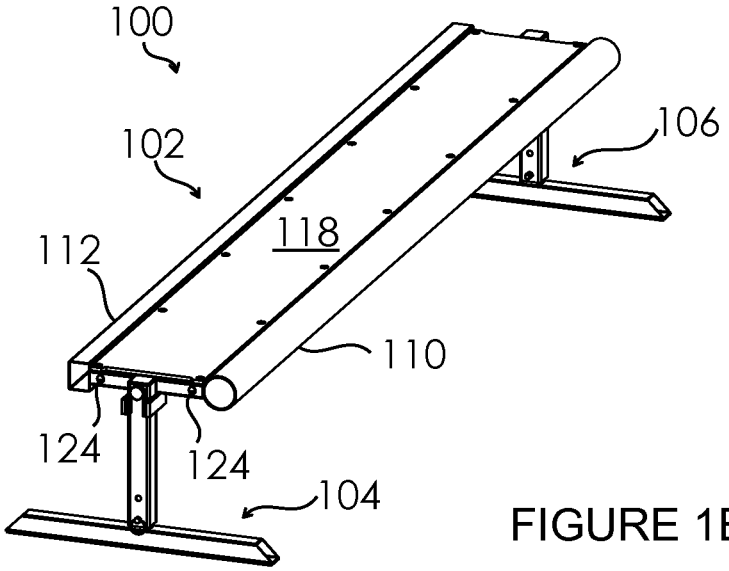

Typically, the transformable obstacle assembly 100 can include a dual rail structure 102, a first support structure 104, and a second support structure 106, as shown in FIGS. 1A-1B. The support structures 104, 106 can be implemented to elevate the dual rail structure 102. In some embodiments, the support structures 104, 106 can be adjustable in height. As shown in FIGS. 3A-3D, the dual rail structure 102 can be adapted to be coupled to the support structures 104, 106 in a horizontal orientation and in a vertical orientation.

The dual rail structure 102 can typically include a first rail 110, a second rail 112, a plurality of ribs 114, a first panel 116, and a second panel 118.

Figure 2A:
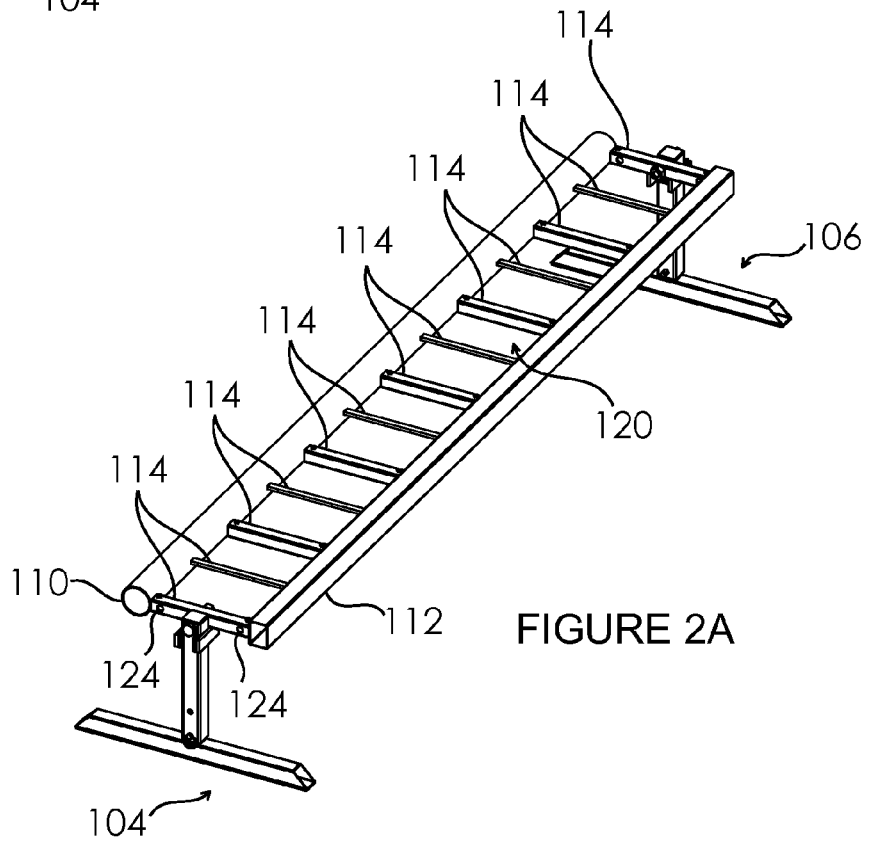
FIGS. 2A-2B are perspective views of a transformable obstacle assembly showing a plurality of ribs according to one embodiment of the present invention.
Figure 2B:
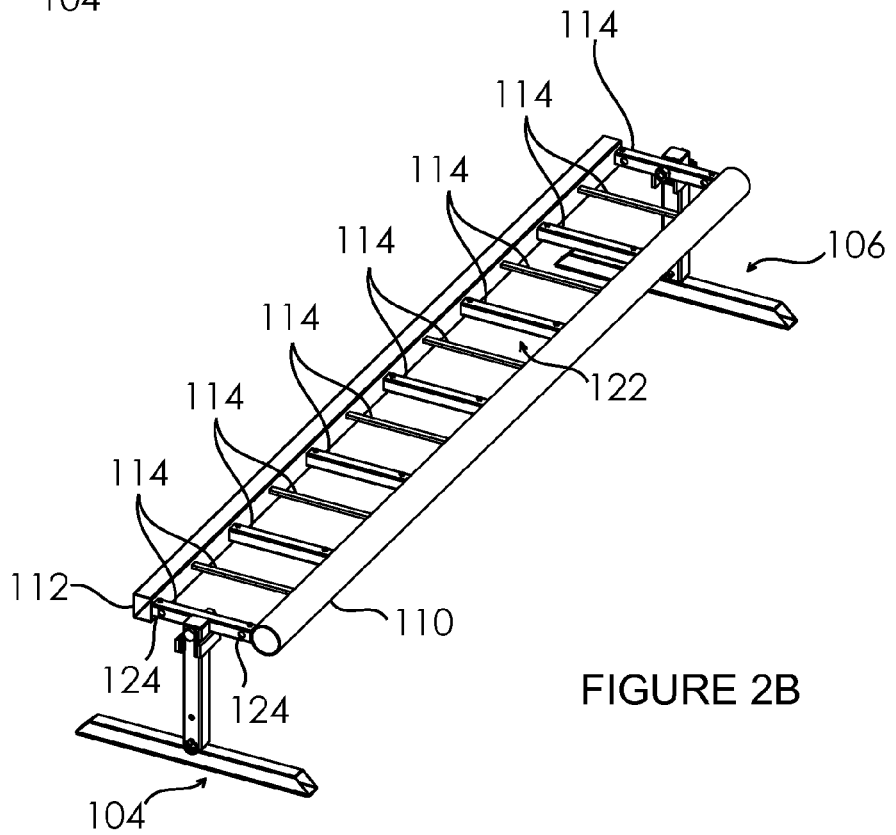

Referring to FIGS. 2A-2B, detailed diagrams of the transformable obstacle assembly 100 without the first panel 116 and the second panel 118 are shown. The plurality of ribs 114 can be implemented to couple the first rail 110 to the second rail 112, as shown in FIGS. 2A-2B. Generally, the first rail 110 and the second rail 112 can be coupled in parallel. In one embodiment, the plurality of ribs 114 can be steel rectangular tubes directly coupled to the first rail 110 and to the second rail 112 via ends of the steel rectangular tubes. In another embodiment, the plurality of ribs 114 can be steel tubes. It is to be appreciated that the plurality of ribs 114 can be manufactured from a variety of rigid materials. For instance, the plurality of ribs 114 can be manufactured from aluminum. In one embodiment, the plurality of ribs 114 can include a combination of tubes and bars. For instance, the plurality of ribs 114 can include one or more steel tubes and one or more steel bars. It is to be further appreciated that the plurality of ribs 114 can generally be a structural member including, but not limited to, a bar, a tube, and a rod comprised of a rigid material adapted to connect the first rail 110 to the second rail 112.

A first side 120 and a second side 122 can be formed when the rails 110, 112 are coupled to the plurality of ribs 114, as shown in FIGS. 2A-2B. In a typical embodiment, the first panel 116 and the second panel 118 can be coupled to different sides of the plurality of ribs 114 between the first rail 110 and the second rail 112, as shown generally in FIGS. 1A-3D. Generally, the first panel 116 can be coupled to the first side 120 of the plurality of ribs 114 and the second panel 118 can be coupled to the second side 122 of the plurality of ribs 114. In one embodiment, the panels 116, 118 can be sized to fit between the first rail 110 and the second rail 112.

In one embodiment, the dual rail structure 102 can include only one of the panels 116, 118. For instance, as shown in FIG. 2A or 2B, the dual rail structure 102 can be implemented with only one of the panels 116, 118 secured to the plurality of ribs 114.

Typically, the first panel 116 and the second panel 118 can be manufactured from a rigid material having a slick surface. For instance, the first panel 116 and the second panel 118 can be manufactured from polyvinyl chloride. It is to be appreciated that other rigid materials having slick surfaces can be implemented without exceeding a scope of the present invention. For example, the first panel 116 and the second panel 118 can be manufactured from steel. In some embodiments, the first panel 116 can be manufactured from a different material than the second panel 118. By implementing varying materials, a user can practice tricks on different surfaces. For instance, the first panel 116 may be a rigid material having a slick surface and the second panel 118 may be a rigid material have a coarse surface.

In one embodiment, the first rail 110 and the second rail 112 can have different shapes. For instance, the first rail 110 can have a tubular structure and the second rail 112 can have a rectangular tube structure. In another instance, the first rail 110 and the second rail 112 can have the same shape. It is to be appreciated that the first rail 110 and the second rail 112 can have a variety of shapes and sizes. Generally, the first rail 110 and the second rail 112 can have substantially the same length.

Figure 3A:
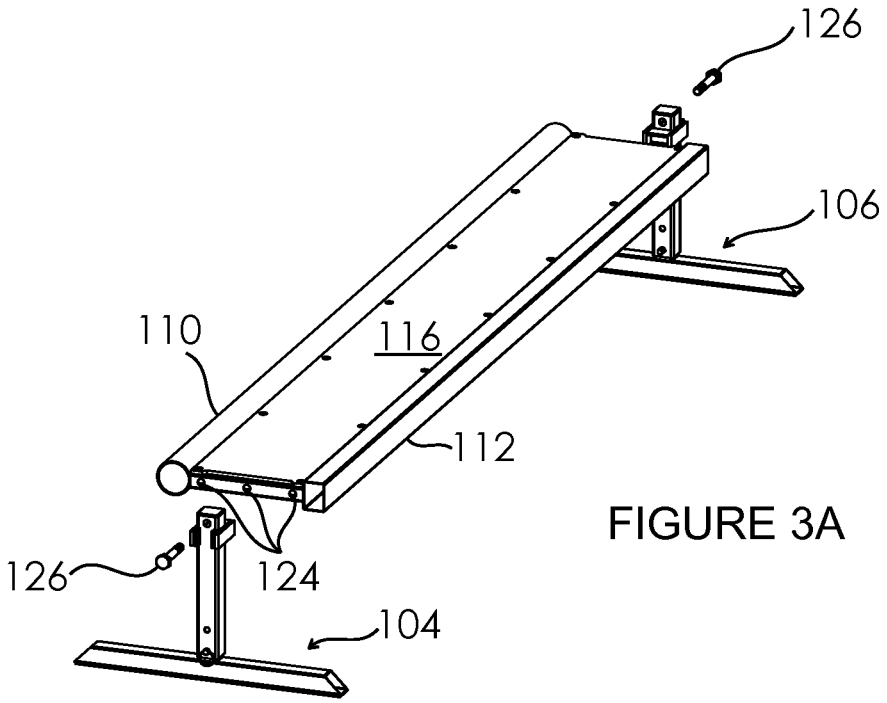
FIG. 3A-3B are exploded views of a transformable obstacle assembly in a horizontal orientation according to one embodiment of the present invention.
Figure 3B:
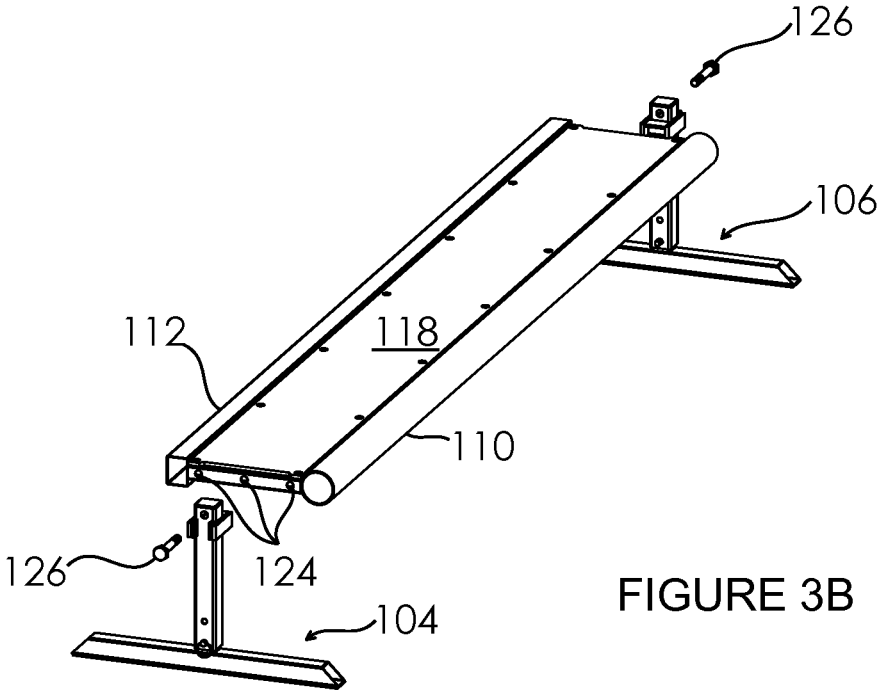
Figure 3C:
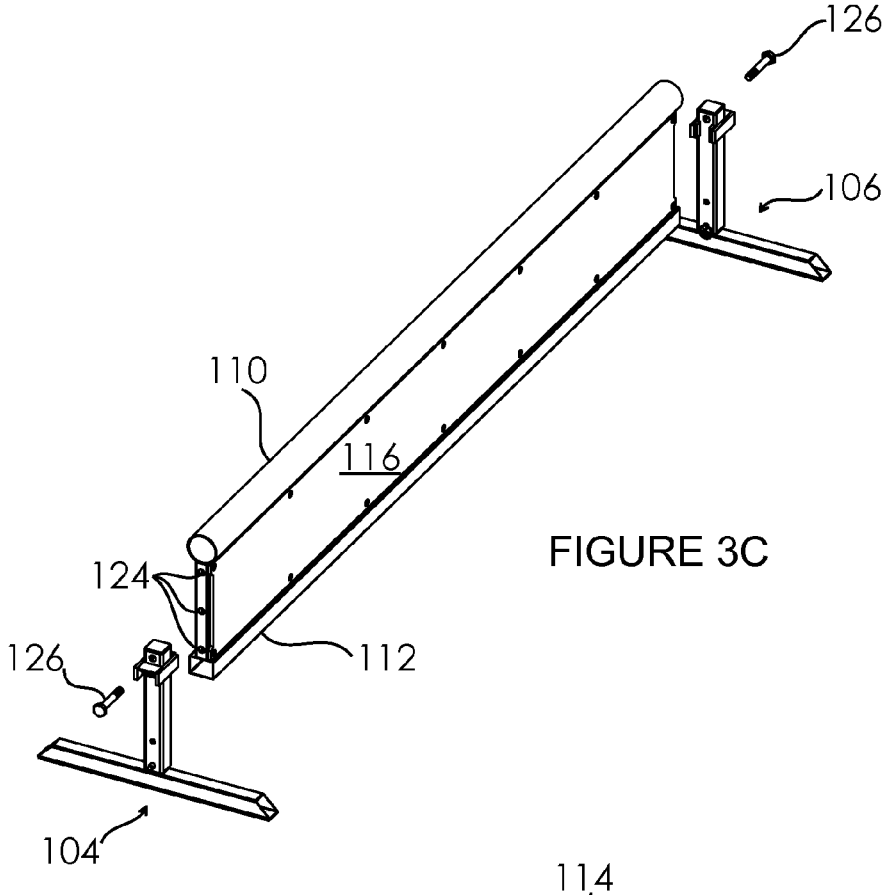
FIGS. 3C-3D are exploded views of a transformable obstacle assembly in a vertical orientation according to one embodiment of the present invention.
Figure 3D:
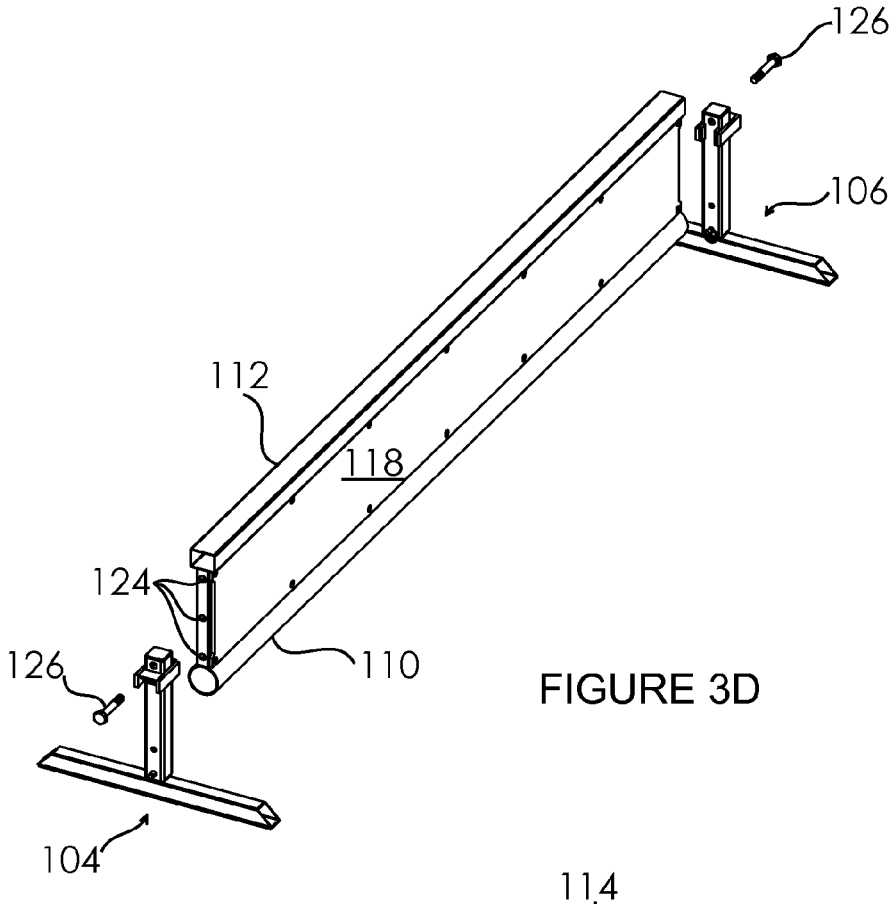

Referring to FIGS. 3A-3D, detailed diagrams of an exploded view of the obstacle assembly 100 in a horizontal orientation and a vertical orientation are illustrated. FIGS. 3A-3B show the obstacle assembly 100 in a horizontal orientation and FIGS. 3C-3D shown the obstacle assembly 100 in a vertical orientation. As shown, the dual rail structure 102 can be rotated from the horizontal orientation to the vertical orientation, and vice versa. Depending on a preference of a user, the first rail 110 and the second rail 112 can be located in one of four different locations. Namely, the first rail 110 and the second rail 112 can be in either a top position or a bottom position when the dual rail structure 102 is in the vertical orientation. Further, the first rail 110 and the second rail 112 can be in either a first position or a second position when the dual rail structure 102 is in the horizontal orientation.

In one embodiment, the plurality of ribs 114 can be steel rectangular tubes welded to the first rail 110 and the second rail 112. Typically, the plurality of ribs 114 can be evenly spaced along a length of the rails 110, 112. As shown, the steel rectangular tubes can be welded perpendicular to the first rail 110 and the second rail 112. It is to be appreciated that the number of steel rectangular tubes and the distance between each tube can be based on a length of the first rail 110 and the second rail 112. It is to be appreciated further that the steel rectangular tubes can be coupled to the first rail 110 and the second rail 112 by a variety of means without exceeding a scope of the present invention.

In a typical implementation, the ribs 114 located proximate ends of the dual rail structure 102 can include one or more holes 124 adapted to receive a rod 126. The rod 126 can be adapted to insert into one of the holes 124 to couple the dual rail structure 102 to one of the support structures 104, 106. In one embodiment, the rod 126 can be a threaded bolt adapted to threadably couple to the ribs 114 located proximate ends of the dual rail structure 102. For instance, the holes 124 can be threaded and adapted to receive the threaded bolt 126. In another instance, a nut can be implemented in combination with the threaded bolt 126 to couple the support structures 102, 106 to one of the end ribs. As shown generally in FIGS. 1A-3D, a rib located at a proximal end of the dual rail structure 102 can include three holes 124. Generally, the pair of ribs located proximate opposite ends of dual rail structure 102 can include the same number of holes. It is to be appreciated that more or less holes may be included with the ribs located proximate ends of the dual rail structure 102.

In FIG. 3A, the obstacle assembly 100 is shown with the dual rail structure 100 in a horizontal orientation with the first rail 110 in a distal position and the second rail 112 in a proximal position. In FIG. 3B, the obstacle assembly 100 is shown with the dual rail structure 100 in a horizontal orientation with the second rail 112 in a distal position and the first rail 110 in a proximal position. In FIG. 3C, the obstacle assembly 100 is shown with the dual rail structure 102 in a vertical orientation with the first rail 110 on top. Assuming the obstacle rail assembly 100 was in a position similar to the one shown in either FIG. 3A or 3B, the dual rail structure 102 would have been rotated 90 degrees and the sleeves 132 on each of the support structures 104, 106 would have been rotated to engage the dual rail structure 102 in the vertical orientation. In FIG. 3D, the dual rail structure 102 is in a vertical orientation with the second rail 112 on top.

Figure 4A:
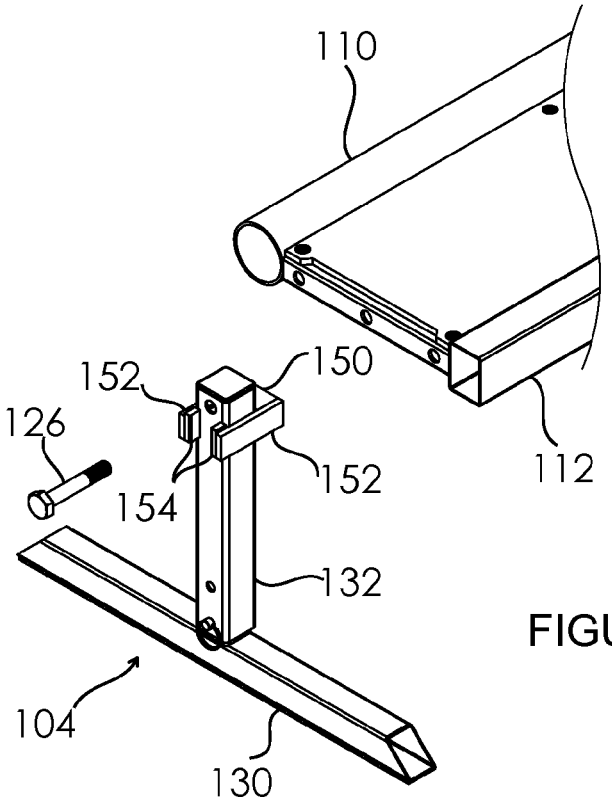
FIG. 4A is a close-up exploded view of a support structure and a dual rail structure in a horizontal orientation according to one embodiment of the present invention.
Figure 4B:
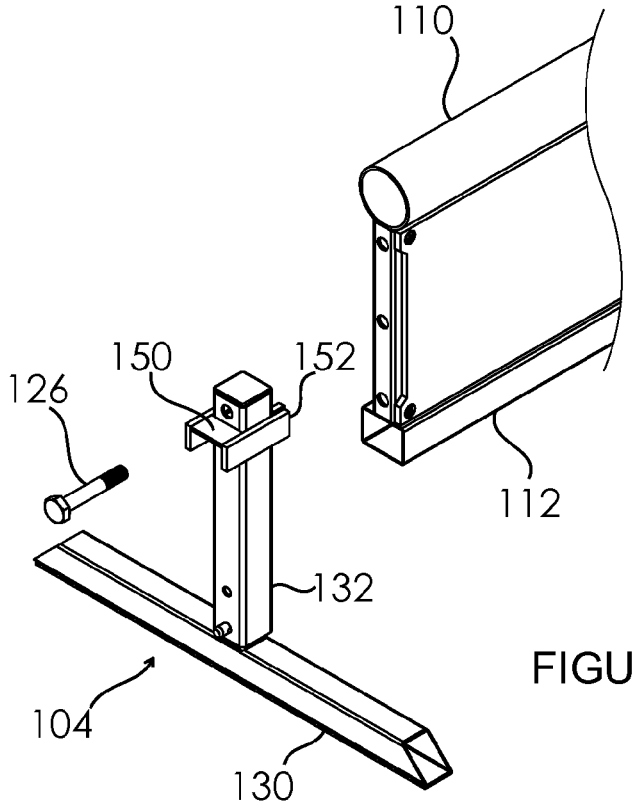
FIG. 4B is a close-up exploded view of a support structure and a dual rail structure in a vertical orientation according to one embodiment of the present invention.
Figure 5:
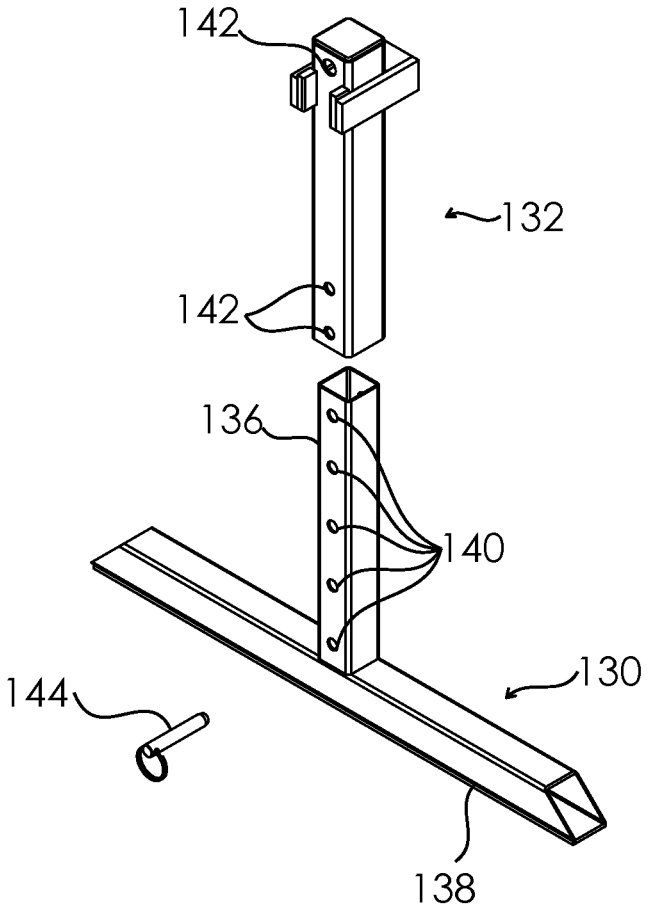
FIG. 5 is an exploded view of a support structure according to one embodiment of the present invention.

Referring to FIGS. 4A-4B and 5, detailed diagrams of one of the support structures 104, 106 are illustrated. FIGS. 4A-4B include detailed diagrams of one example of how the support structures 104, 106 interface with the dual rail structure 102. FIG. 4A illustrates one example of how the dual rail structure 102, in a horizontal orientation, interfaces with one of the support structures 104, 106. FIG. 4B illustrates one example of how the dual rail structure 102, in a vertical orientation, interfaces with the support structures 104, 106. FIG. 5 includes an exploded view of one of the support structures 104, 106.

As shown, the support structures 104, 106 can be implemented to elevate and stabilize the dual rail structure 102 above a surface. Typically, the first support structure 104 and the second support structure 106 can be identical. In one embodiment, the support structures 104, 106 can each include a T-shaped frame 130 and a sleeve 132. The sleeve 132 can be adapted to slidably engage the T-shaped frame 130. For instance, the sleeve 132 can be a tube having an inner diameter slightly bigger than an outer diameter of the T-shaped frame 130. As such, the T-shaped frame 130 can slide in and out of the sleeve 132. Generally, the sleeve 132 can be adapted to be removably engaged to the T-shaped frame 130 such that the sleeve 132 can be removed, rotated, and then engaged back to the T-shaped frame 130. In a typical implementation, the first support structure 104 and the second support structure 106 can be coupled to opposite ends of the dual rail structure 102 via the pair of rods 126.

Referring to FIG. 5, an exploded view of one of the support structures 104, 106 is illustrated. As shown, the T-shaped frames 130 can generally include a substantially vertical portion 136 and a substantially horizontal portion 138. As shown, the substantially vertical portion 136 can interface with the sleeve 132 and the substantially horizontal portion 138 can interface with the ground or other surface. In one embodiment, the vertical portion 136 can include a plurality of holes 140. The sleeve 132 can include one or more holes 142. The sleeve holes 142 can be located proximate an upper and a lower portion of the sleeve 132, as shown in FIG. 5. The upper hole can be implemented to couple the sleeve 132 to the dual rail structure 102 and the lower hole can be implemented to couple the sleeve 132 to the vertical portion 136. It is to be appreciated that the number of holes on the vertical portion 136 and the sleeve 132 can be increased or decreased without exceeding a scope of the present invention.

As shown generally in FIGS. 4A-5, the vertical portion holes 140 and the sleeve holes 142 can be adapted to line up to one another. Typically, a fastening mechanism 144 can be implemented to pass through one of the vertical portion holes 140 and a corresponding sleeve hole 142 to couple the sleeve 132 to the T-shaped frame 130. It is to be appreciated that the fastening mechanism 144 can include, but is not limited to, a threaded rod, a rod, a clevis pin, etc. As such, the sleeve 132 can be moved along a length of the vertical portion 136 to elevate or lower the sleeve 132 and be coupled to the vertical portion 136.

Referring back to FIGS. 4A-4B, one side of the sleeve 132 can be adapted to interface with the dual rail structure 102 when in a horizontal orientation and an opposite side of the sleeve 132 can be adapted to interface with the dual rail structure 102 when in a vertical orientation. To interface with the dual rail structure 102 in a horizontal orientation, the sleeve 132 can typically include a horizontal flange 150 that extends out from the sleeve 132 to engage a bottom surface of a rib of the dual rail structure 102. To interface with the dual rail structure 102 in a vertical orientation, the sleeve 132 can include a pair of flanges 152 that extend out from sides of the sleeve 132 and engage sides of a rib of the dual rail structure 102. In one embodiment, a friction pad 154 can be implemented on an interior of each of the pair of flanges 152. The friction pads 154 can be implemented to secure the dual rail structure 102 to the support structure 104. It is to be appreciated that the flanges 150, 152 on the sleeve 132 can be implemented to keep the dual rail structure 102 from rotating.

Further shown in FIGS. 4A-4B is the pair of rods 126 that can be implemented to couple the support structures 104, 106 to the dual rail structure 102. Generally, each of the rods 126 can be passed through a sleeve hole 142 located above the sleeve flanges 150, 152 and then inserted into one of the holes 124 of an end rib of the dual rail structure 102.

Figure 6A:
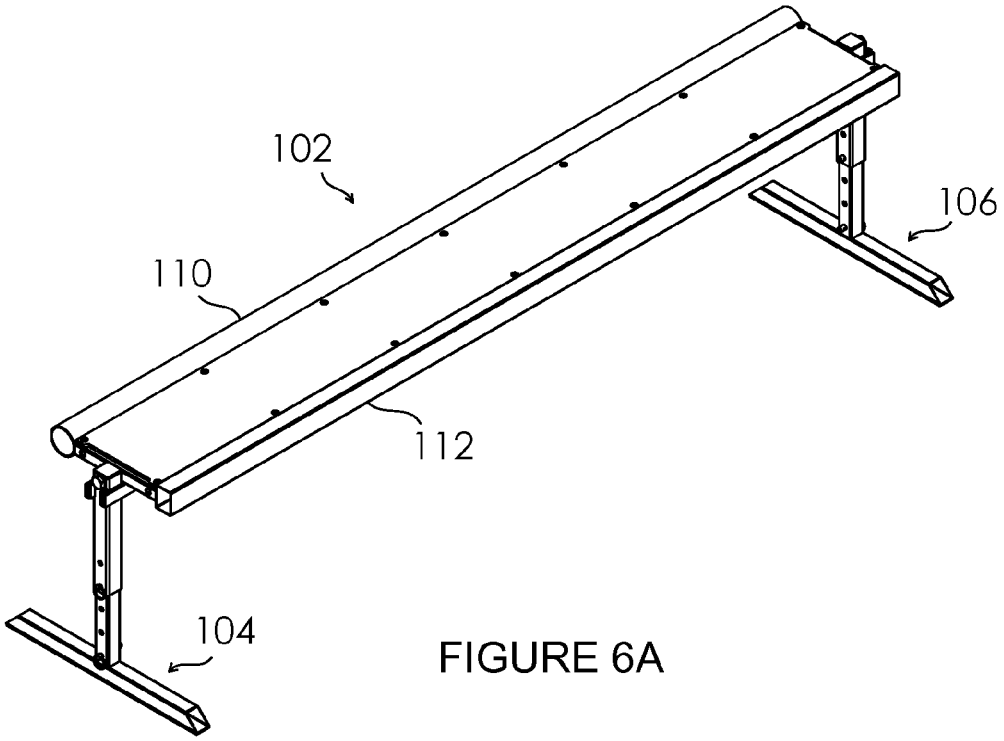
FIG. 6A is a perspective view of a transformable obstacle assembly adjusted in height according to one embodiment of the present invention.
Figure 6B:
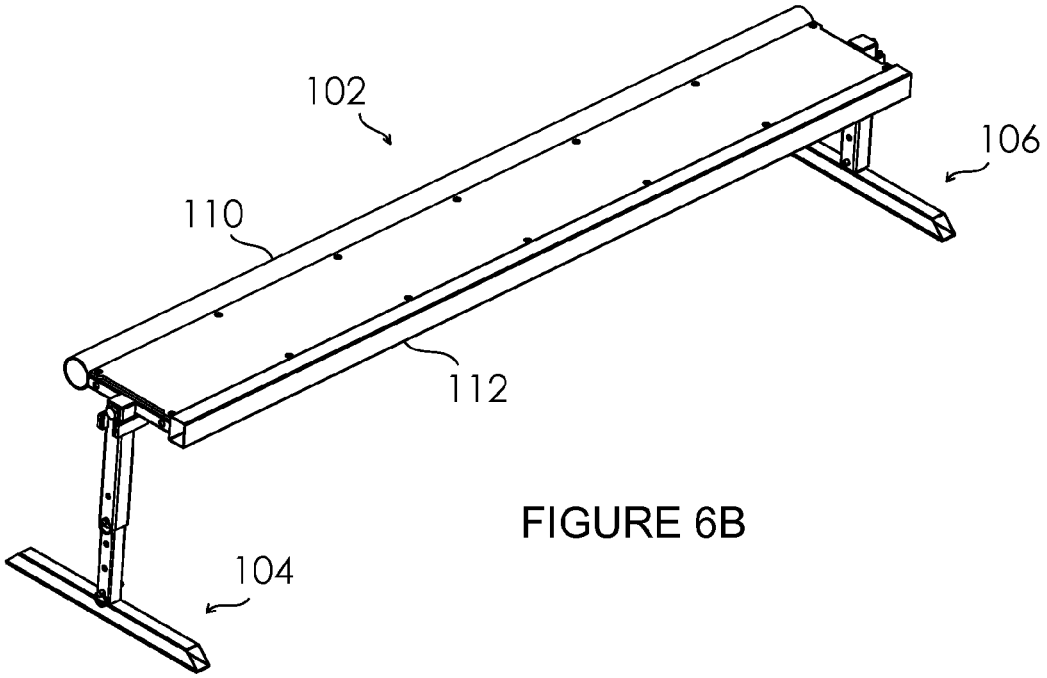
FIG. 6B is a perspective view of a transformable obstacle assembly having two different heights according to one embodiment of the present invention.

Referring to FIGS. 6A-6B, detailed diagrams of the transformable obstacle assembly 100 in various positions is illustrated. FIG. 6A shows the obstacle assembly 100 being in an elevated position by sliding the sleeve 132 up the vertical portion 136 and securing the sleeve 132 to an upper portion of the vertical portion 136. As shown, each of the sleeves 132 of the first support structure 104 and the second support structure 106 are at the same height. In FIG. 6B, the sleeves 132 on each of the support structures 104, 106 are at different heights giving the obstacle assembly 100 a slope.

A Second Embodiment of a Transformable Obstacle Assembly

Referring to FIGS. 7A-8B, detailed diagrams of a second embodiment 200 of a transformable obstacle assembly is illustrated. Generally, the second embodiment obstacle assembly 200 can be similar to the first embodiment transformable obstacle assembly 100.

The second embodiment obstacle assembly 200 can include components similar to the first embodiment assembly 100. As shown in FIGS. 7A-8B, the second embodiment obstacle assembly 200 can include a dual rail structure 202, a first support structure 204, and a second support structure 206. The second embodiment support structures 204, 206 can be substantially similar to the first embodiment support structures 104, 106 and can be implemented similarly.

The second embodiment dual rail structure 202 can be similar to the first embodiment dual rail structure 102, but can include curved rails and curved panels. Generally, the curved dual rail structure 202 can include a first curved rail 210, a second curved rail 212, a plurality of ribs 214, a first curved panel 216, and a second curved panel 218.

As shown, the curved dual rail structure 202 can be combined similar to the first embodiment dual rail structure 102. For instance, as shown in FIGS. 7B and 8B, the plurality of ribs 214 can be implemented to couple the first curved rail 210 to the second curved rail 212. Similar to the first embodiment plurality of ribs 114, the second embodiment plurality of ribs 214 can include a combination of tubes and bars. The curved panels 216, 218 can then be coupled to either side of the structure formed by the plurality of ribs 214 and rails 210, 212.

Figure 7A:
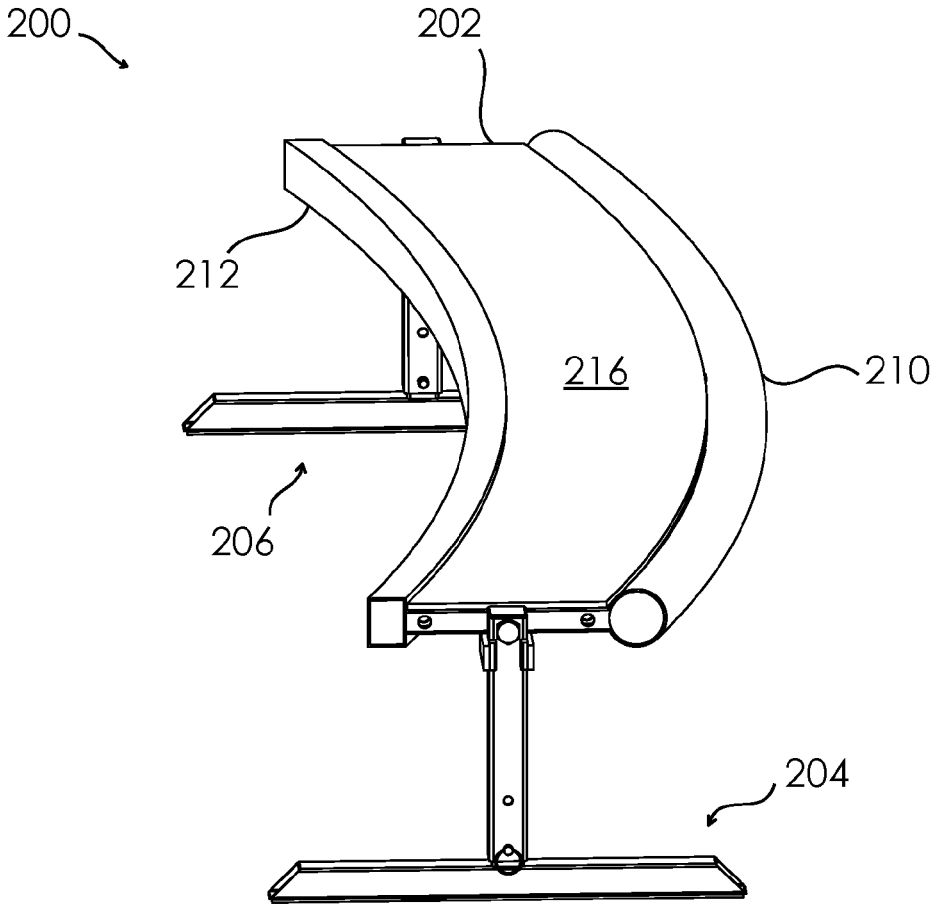
FIGS. 7A-7B are front perspective views of a transformable obstacle assembly having curved rails according to one embodiment of the present invention.
Figure 7B:
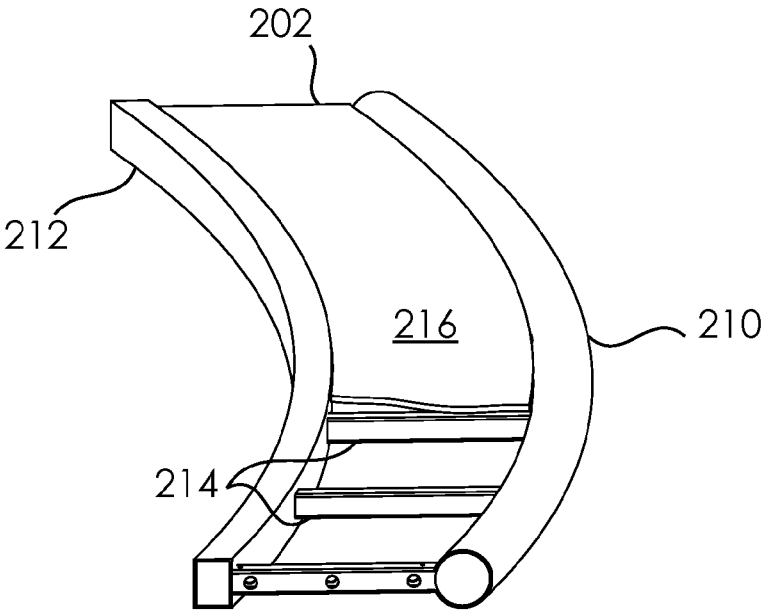

In one embodiment, the plurality of ribs 214 can be coupled to the rails 210, 212 such that ends of the plurality of ribs 214 are coupled to a concave face and a convex face of a respective rail, as shown in FIGS. 7A-7B. As shown in FIGS. 7A-7B, when the curved dual rail structure 202 is in a horizontal orientation, the curved dual rail structure 202 can be curved in a horizontal plane. It is to be appreciated that when the curved dual rail structure 202 is in a vertical orientation, the curved dual rail structure 202 can be curved in a vertical plane forming either a domed or concave shape depending on which side is on top.

Figure 8A:
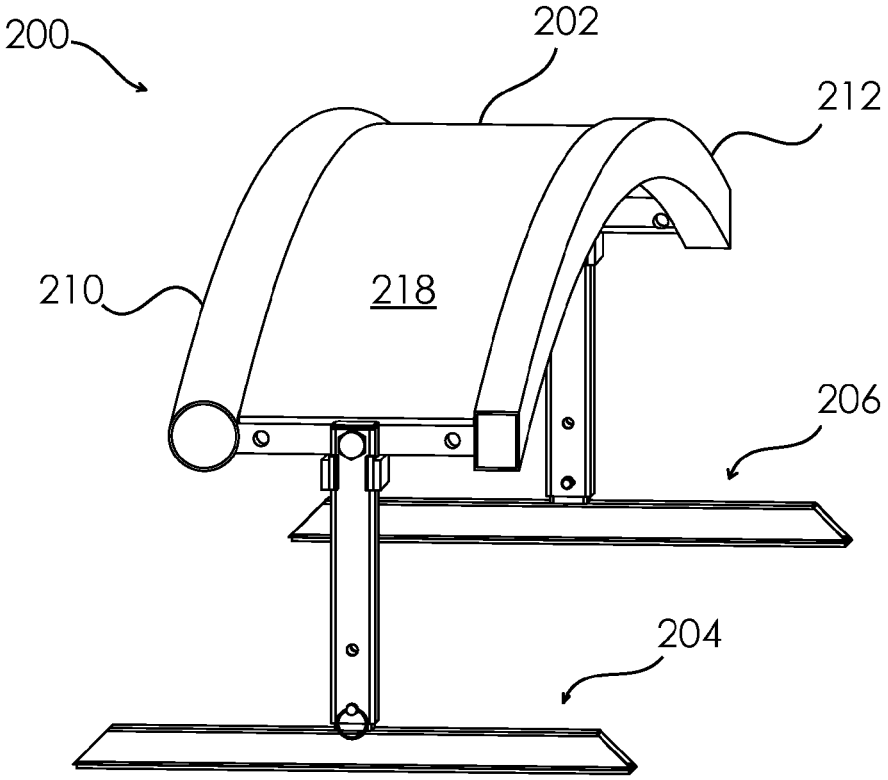
FIGS. 8A-8B are front perspective views of a transformable obstacle assembly having curved rails according to one embodiment of the present invention.
Figure 8B:
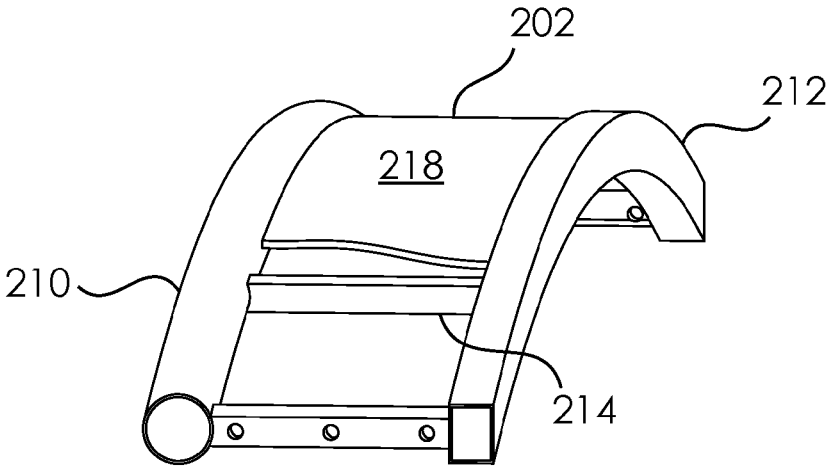

In another embodiment, the plurality of ribs 214 can be coupled to the rails 210, 212 such that ends of the plurality of ribs 214 are coupled to faces of the rails 210, 212 that are adjacent to the concave/convex faces of the rails 210, 212, as shown in FIGS. 8A-8B. As shown in FIGS. 8A-8B, when the curved dual rail structure 202 is in a horizontal orientation, the curved dual rail structure 202 can be curved in a vertical plane forming a domed or concave shape depending on which side is on top. It is to be appreciated that when the curved dual rail structure 202 is in a vertical orientation, the curved dual rail structure 202 can be curved in a horizontal plane.

A Third Embodiment of a Transformable Obstacle Assembly

Figure 9A:
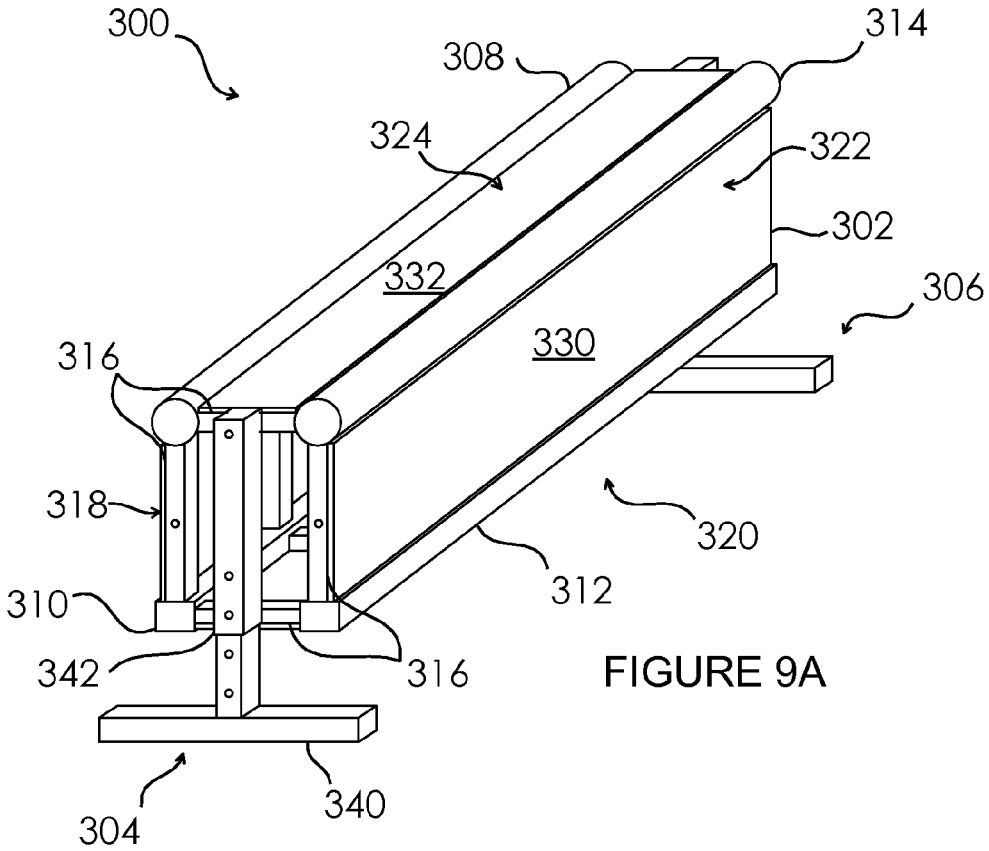
FIGS. 9A-9B are perspective views of a transformable obstacle assembly having four rails according to one embodiment of the present invention.
Figure 9B:
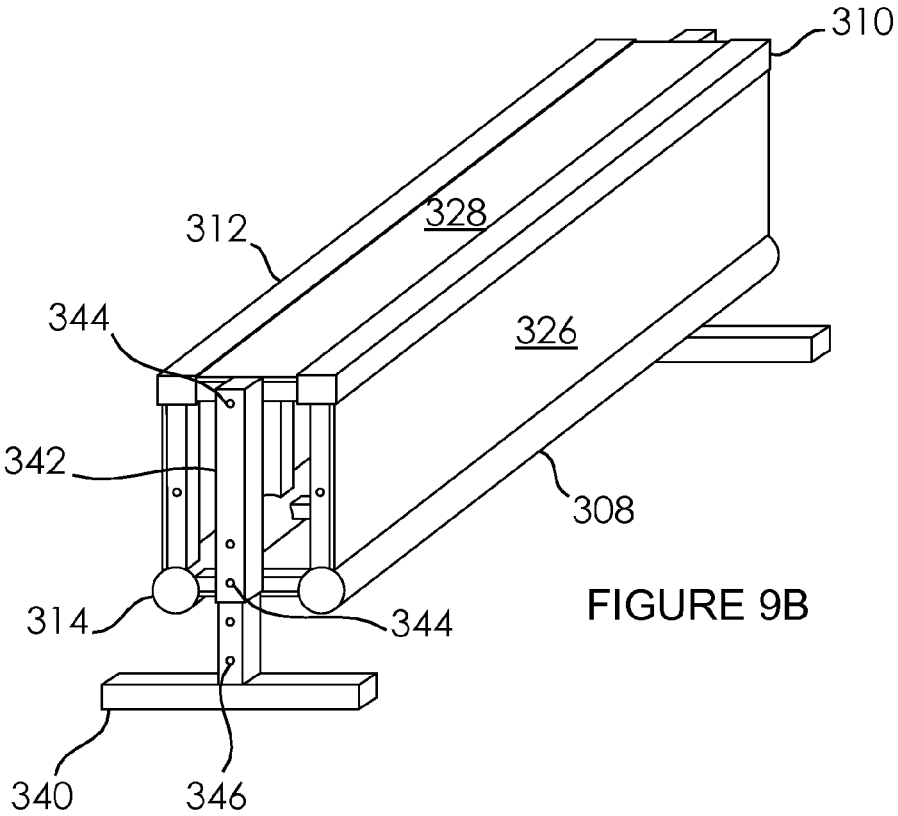

Referring to FIGS. 9A-9B, detailed diagrams of a third embodiment 300 of a transformable obstacle assembly is illustrated. Generally, the third embodiment obstacle assembly 300 can include a pair of support structures similar to the first embodiment support structures and can be implemented similar to the first embodiment obstacle assembly 100.

As shown generally in FIGS. 9A-9B, the third embodiment obstacle assembly 300 can include a quad rail structure 302, a first support structure 304, and a second support structure 306. The quad rail structure 302 can generally include a first rail 308, a second rail 310, a third rail 312, a fourth rail 314, and a plurality of ribs 316. Generally, the quad rail structure 302 can be coupled together to form an elongated box having a square or rectangular cross-section. It is to be appreciated that other shapes can be formed from the quad rail structure 302 without exceeding a scope of the present invention.

In one embodiment, the first rail 308 and the fourth rail 314 can have a tubular shape with a substantially circular cross-section and the second rail 310 and the third rail 312 can each have a rectangular tube shape with a substantially square cross-section. In another embodiment, the first rail 308 and the second rail 310 can have similar shapes and the third rail 312 and the fourth rail 314 can have similar shapes. It is to be appreciated that any combination of the rails can be implemented in the third embodiment obstacle assembly 300.

The third embodiment obstacle assembly 300 can include the plurality of ribs 316 to couple the rails 308-314 to each other. Similar to the first embodiment ribs 114, the third embodiment ribs 316 can include steel tubes to secure the rails 308-314 together. In one embodiment, the steel tubes can be welded to each of the rails 308-314.

A first side 318, a second side 320, a third side 322, and a fourth side 324 can be formed when the rails 308-314 are coupled together by the plurality of ribs 316.

In a typical embodiment, the third embodiment obstacle assembly 300 can include a first panel 326, a second panel 328, a third panel 330, and a fourth panel 332. The panels 326-332 can be coupled to the sides 318-324 of the quad rail structure 302 that are formed when the plurality of ribs 316 couple each of the rails 308-314 together. As shown, the panels 326-332 can be located between the rails 308-314, as shown in FIGS. 9A-9B. Generally, the first panel 326 can be coupled to the first side 318, the second panel 328 can be coupled to the second side 320, the third panel 330 can be coupled to the third side 322, and the fourth panel 332 can be coupled to the fourth side 324. Typically, the panels 326-332 can be sized to fit between the rails 308-314.

In one embodiment, the plurality of ribs 316 can be steel rectangular tubes welded to each of the rails 308-314. Typically, the plurality of ribs 316 can be evenly spaced along a length of the rails 308-314. For illustrative purposes only, the plurality of ribs 316 can include 4 subsets of ribs. A first subset can couple the first rail 308 to the second rail 310, a second subset can couple the second rail 310 to the third rail 312, a third subset can couple the third rail 312 to the fourth rail 314, and a fourth subset can couple the fourth rail 314 to the first rail 308. It is to be appreciated that the number of steel rectangular tubes and the distance between each tube can be based on a length of the rails 308-314. It is to be appreciated further that the steel rectangular tubes can be coupled between the rails 308-314 by a variety of means without exceeding a scope of the present invention. Similar to the first embodiment plurality of ribs 114, the third embodiment plurality of ribs 316 can include a combination of tubes and bars.

The support structures 304, 306 can be implemented to elevate and stabilize the quad rail structure 302 above a surface. In one embodiment, the quad rail structure 302 can be implemented with both of the support structures 304, 306. In another embodiment, only one of the support structures 304, 306 can be implemented with the quad rail structure 302. In yet another embodiment, the quad rail structure 302 can be implemented without either of the support structures 304, 306.

Typically, the first support structure 304 and the second support structure 306 can be identical. In one embodiment, the support structures 304, 306 can each include a T-shaped frame 340, a sleeve 342, and a pair of rods 344. The sleeve 342 can be adapted to slidably engage the T-shaped frame 340. In a typical implementation, the first support structure 304 and the second support structure 306 can be coupled to opposite ends of the quad rail structure 302 via the pair of rods 344. For instance, individual ribs 316 located proximate ends of the quad rail structure 302 can each include a hole similar to the first embodiment rib hole 124 that is adapted to receive one of the rods 344. As shown, the pair of rods 344 can be inserted into different ribs located proximate ends of the quad rail structure 302.

In one embodiment, the first embodiment support structures 104, 106 can be implemented with the quad rail structure 302. In such an embodiment, the quad rail structure 302 can couple to the first embodiment support structures 104, 106 similarly to how the dual rail structure 102 couples to the first embodiment support structures 104, 106.

The T-shaped frames 340 can generally include a substantially vertical portion and a substantially horizontal portion similar to the first embodiment T-shaped frames 130. As shown, the substantially vertical portion can interface with the sleeve 342 and the substantially horizontal portion can interface with the ground or other surface. In one embodiment, the vertical portion can include a plurality of holes 346. The sleeve 342 can include at least two holes for receiving the pair of rods 344. The sleeve holes can be located proximate an upper and a lower portion of the sleeve 342, as shown generally by the rods 344 in FIGS. 9A-9B. The sleeve holes can be implemented to couple the support structures 304, 306 to the quad rail structure 302. It is to be appreciated that the number of holes on the vertical portion 346 and the sleeve 342 can be increased or decreased without exceeding a scope of the present invention.

As shown generally in the Figures, the vertical portion holes 346 and the sleeve holes can be adapted to line up to one another. Typically, the pair of rods 344 can be implemented to pass through one of the vertical portion holes 346 and a corresponding sleeve hole. As such, the sleeve 342 can be moved along a length of the vertical portion 346 to elevate or lower an overall height of the third embodiment transformable obstacle assembly 300.

In an alternative embodiment, the quad rail structure 302 can include curved rails similar to those previously disclosed in the second embodiment transformable obstacle assembly. For instance, the quad rail structure 302 can include curved rails similar to the curved rails shown in FIGS. 7A-8B. For example, the four rails can be curved vertically or horizontally depending on an implementation.

Alternative Embodiments of Support Structure Coupling Means

Referring to FIGS. 10A-10E, a plurality of detailed diagrams of alternative means to couple a rail structure to one of the support structures are illustrated. Generally, each of the illustrated coupling means can be implemented with each of the previously described transformable obstacle assemblies 100, 200, and 300. Typically, each of alternative means described hereinafter can be implemented with a support structure sleeve and a rail structure rib.

Figure 10A:
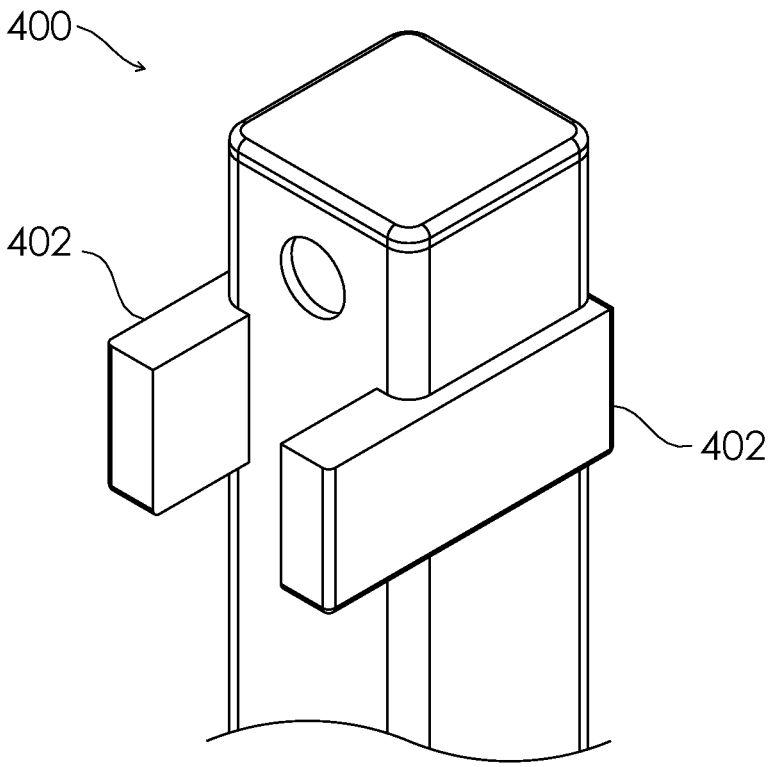
FIGS. 10A-10E are perspective views of alternative coupling means according to embodiments of the present invention.

Referring to FIG. 10A, an alternative embodiment of a sleeve flange 400 adapted to interface with one of the rail structures 102, 202, 302 is illustrated. The sleeve flange 400 can be implemented to couple with the rail structures when the rail structures are in either a horizontal orientation or a vertical orientation.

As shown, the sleeve flange 400 can include a pair of flanges 402 located on opposite sides of the sleeve that extend out in substantially the same direction from the sleeve. As shown, the sleeve flanges 402 can be coupled to either side of the sleeve near an upper portion of the sleeve. Generally, a portion of the flanges 402 located away from the sleeve can have a greater thickness than a portion of the flanges 402 located proximate the sleeve. For instance, the portion of the sleeve flanges 402 located away from the sleeve can include a top surface having a width of approximately ⅛" to 1". Typically, an overall thickness of the portion of the flanges 402 extended out can be determined by a width of the ribs implemented in the rail structures 102, 202, 302. Generally, a distance between an interior of the pair of flanges 402 can be approximately equal to a width of the end ribs. In one embodiment, the pair of flanges 402 can include a tolerance approximately between 0.0005 inches to 0.05 inches.

Figure 10E:
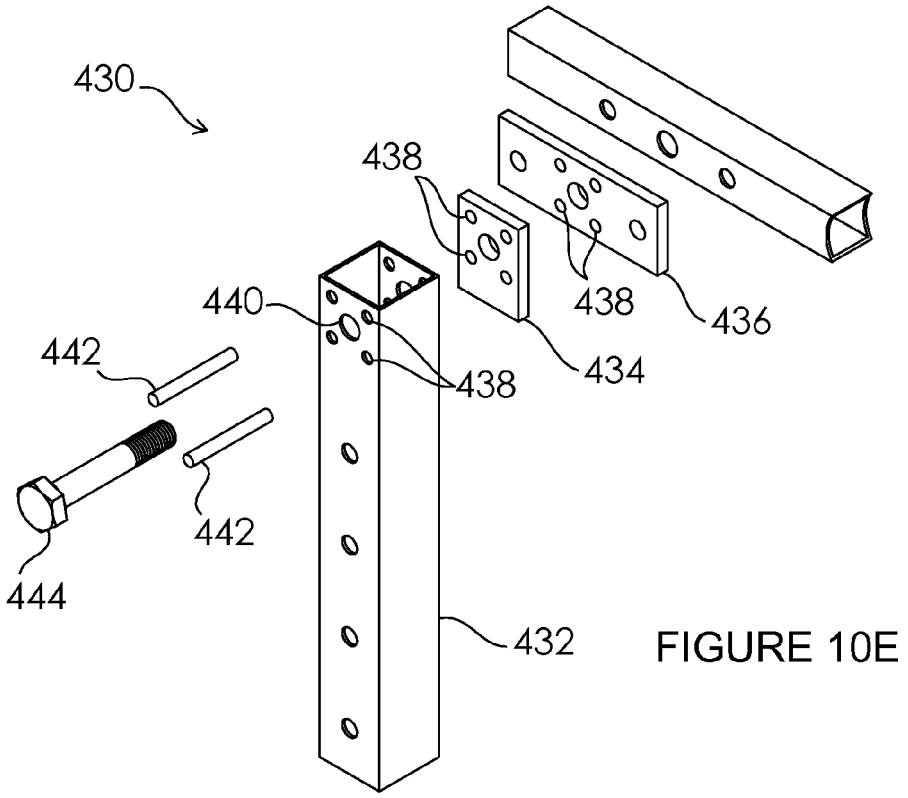
Figure 10B:
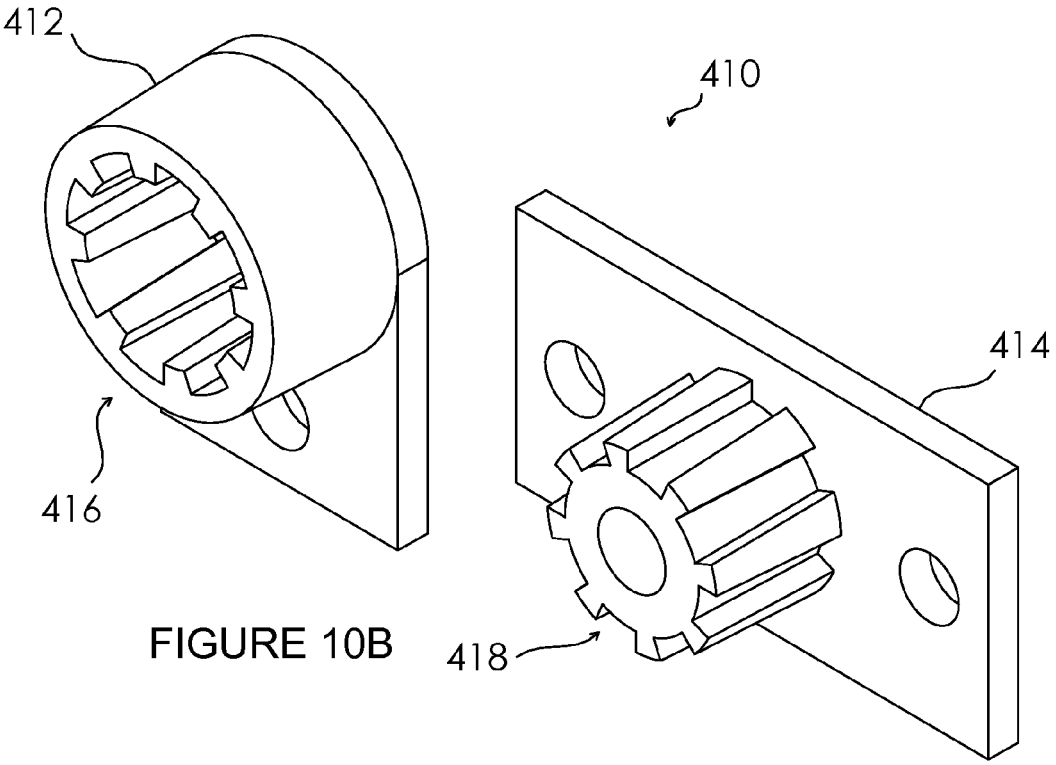

Referring to FIG. 10B, an embodiment of a toothed hinge coupling assembly 410 is illustrated. Generally, the toothed hinge coupling assembly 410 can include a sleeve structure 412 and a rib structure 414, as shown in FIG. 10B. The sleeve structure 412 can be adapted to couple to a support structure sleeve and the rib structure 414 can be implemented to couple to an end rib of a rail structure. As shown, the sleeve structure 412 can include a female member 416 and the rib structure 414 can include a male member 418. The male member 418 can be adapted to mate with the female member 416. Generally, to rotate a rail structure in relation to a support structure, the male member 418 can be removed from the female member 416, rotated clockwise or counterclockwise, and then reinserted into the female member 416. Typically, depending on the number of teeth the structures include 412, 414, a user can rotate the rail structure to a plurality of different orientations in relation to the support structures.

In one embodiment, the structures 412, 414 can be coupled to the sleeve and the rib via a fastening mechanism. In another embodiment, the structures 412, 414 can be welded to the sleeve and the rib. It is to be appreciated that a variety of means of securing the structures 412, 414 to the sleeve and the rib are contemplated. It is to be further appreciated that the male member 418 may be adapted to be coupled to a sleeve and the female member 416 may be adapted to be coupled to a rib.

Figure 10C:
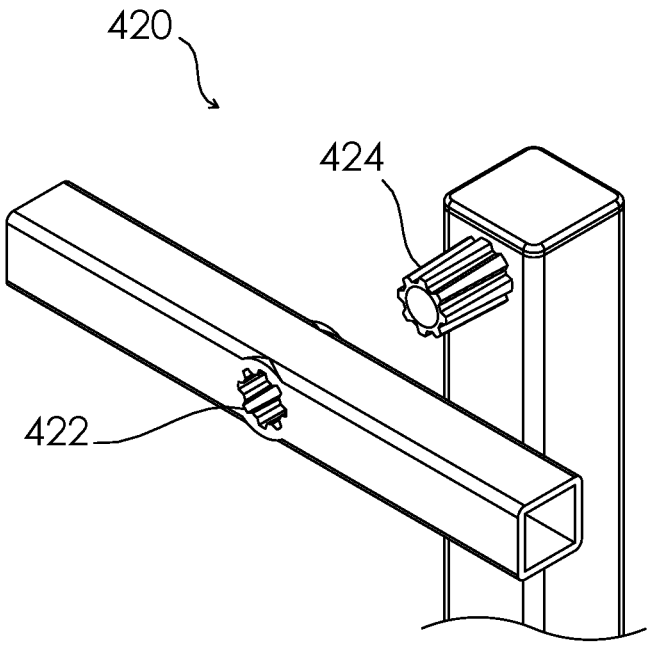
Figure 10C:
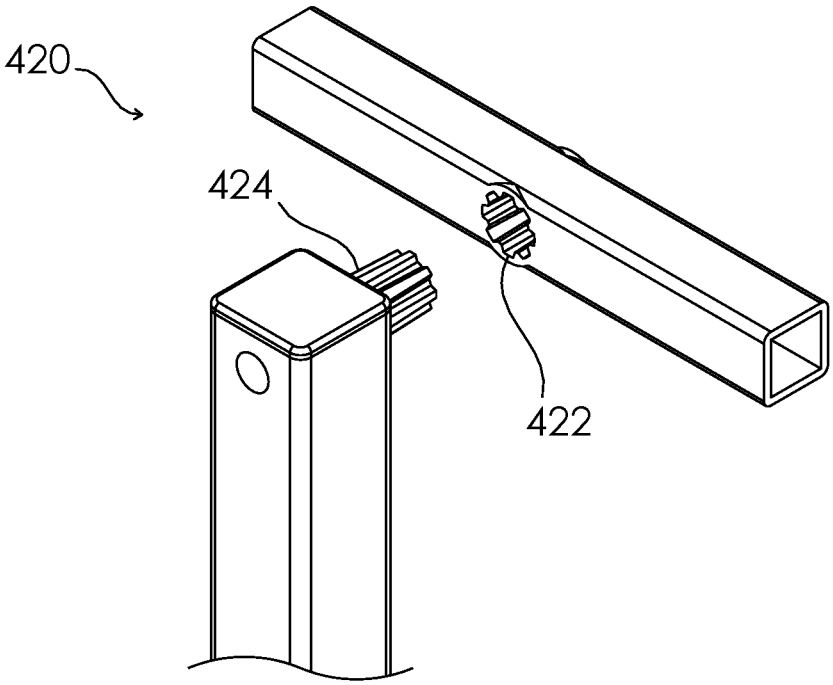
Figure 10D:
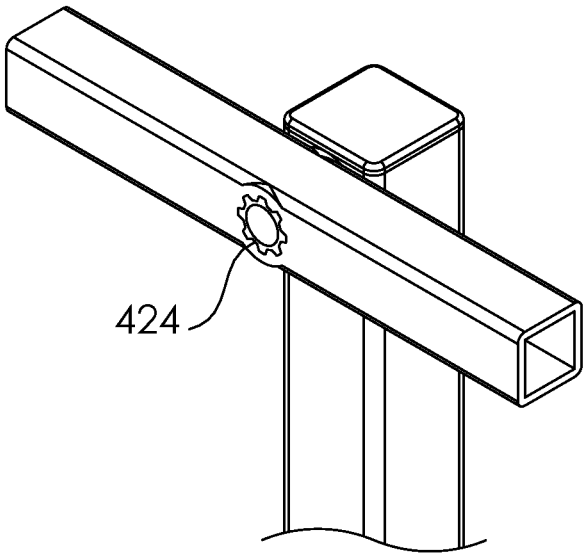
Figure 10D:
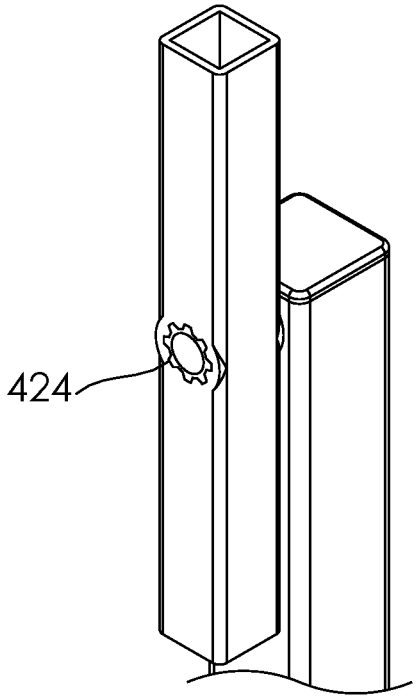

Referring to FIGS. 10C-10D, an embodiment of a coupling means 420 is illustrated. Typically, the coupling means 420 can be implemented similarly to the previously discussed toothed hinge coupling means 410 shown in FIG. 10B. The coupling means 420 can include a first attachment member 422 and a second attachment member 424. Generally, the first attachment member 422 and the second attachment member 424 can be selected from a toothed hinge and a receptacle adapted to receive the toothed hinge.

In one example, as shown, a male toothed hinge 424 can be coupled to a rail structure sleeve and a female receptacle 422 can be formed in an end rib. The female receptacle 422 can be adapted to receive the male toothed hinge 424. The male toothed hinge 424 can be adapted to rotate in set increments based on a number of teeth of the hinge. As such, the coupling means 420 can be implemented to rotate a rail structure in set increments.

FIG. 10D includes detailed diagrams of the coupling means 420 implemented so that the end rib is in a vertical orientation and in a horizontal orientation in relation to the rail structure sleeve.

Referring to FIG. 10E, an alternative embodiment of a support structure coupling means 430 is illustrated. Generally, the coupling means 430 can include a modified sleeve 432, a first plate 434, and a second plate 436. As shown, the modified sleeve 432, the first plate 434, and the second plate 436 can each include four holes 438 surrounding a main hole 440.

In a typical implementation, the first plate 434 can be coupled to the modified sleeve 432 and the second plate 436 can be coupled to an end rib of one of the rail structures 102, 202, 302. For instance, the first plate 434 and the second plate 436 can each be welded to the modified sleeve 432 and end rib, respectively. In another instance, the first plate 434 can be welded to the modified sleeve 432 and the second plate 436 can be coupled via one or more fastening mechanisms to the end rib. One or more rods 442 can be implemented to pass through the four holes 438 to couple the modified sleeve 432 to the end rib. The one or more rods 442 can be implemented to keep the components from rotating in relation to one another. A main rod 444 can be passed through the main hole 440 of the modified sleeve 432, the first plate 434, the second plate 436, and the end rib to connect the modified sleeve 432 to the end rib and provide a pivot.

Alternative Embodiment of a Dual Rail Structure

Figure 11A:
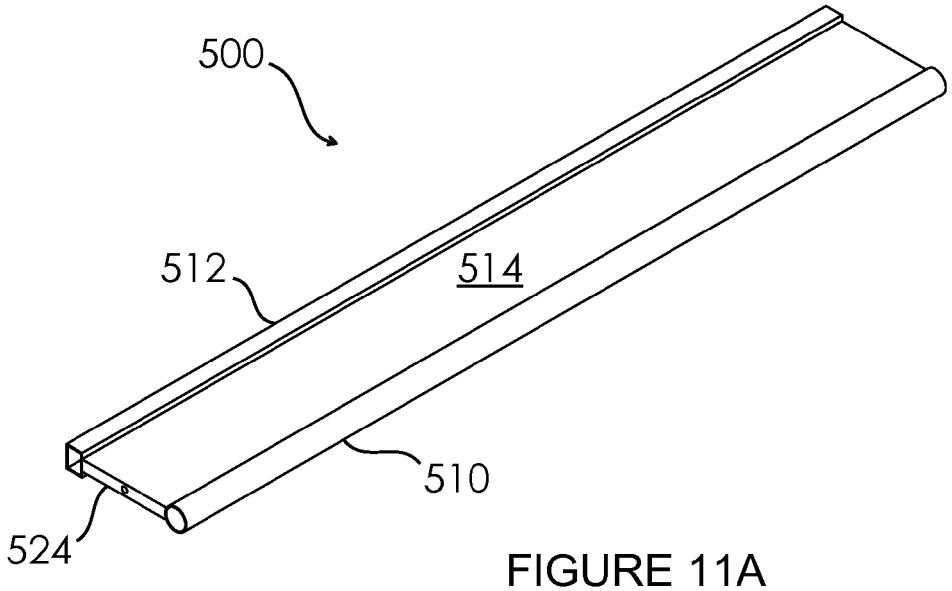
FIGS. 11A-11D are perspective views of an alternative dual rail structure according to one embodiment of the present invention.
Figure 11B:
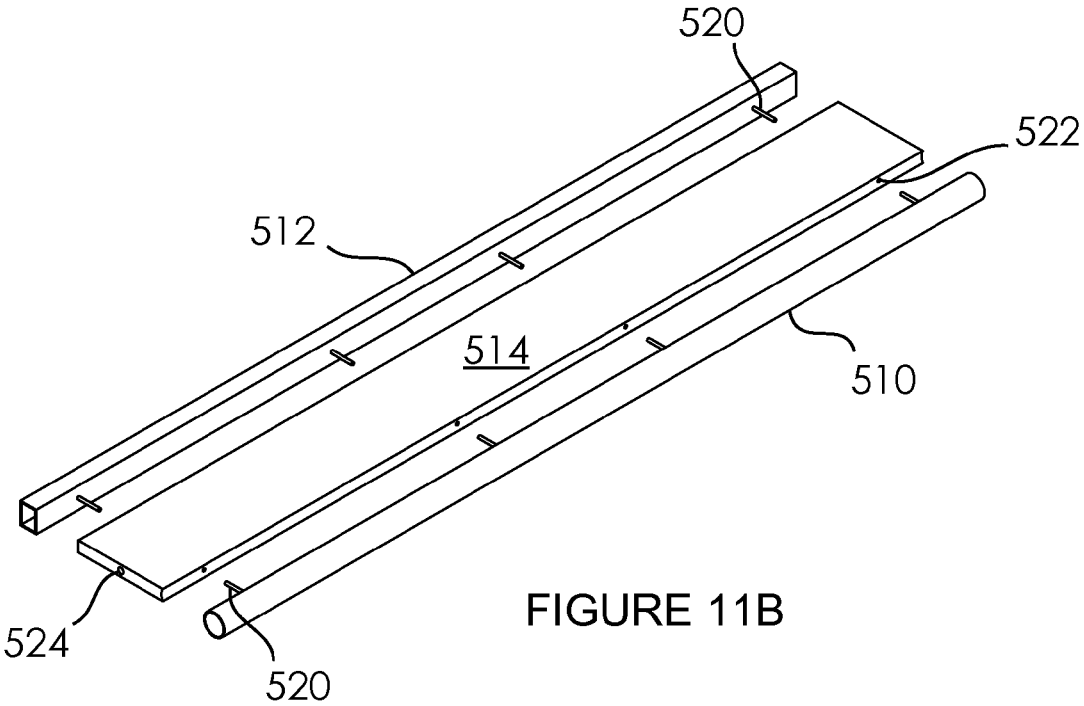
Figure 11C:
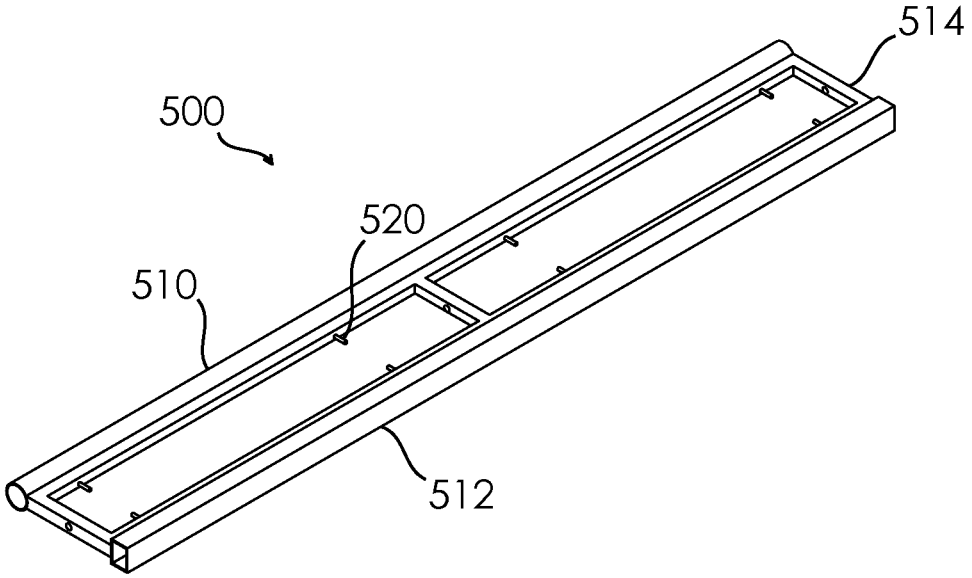
Figure 11D:
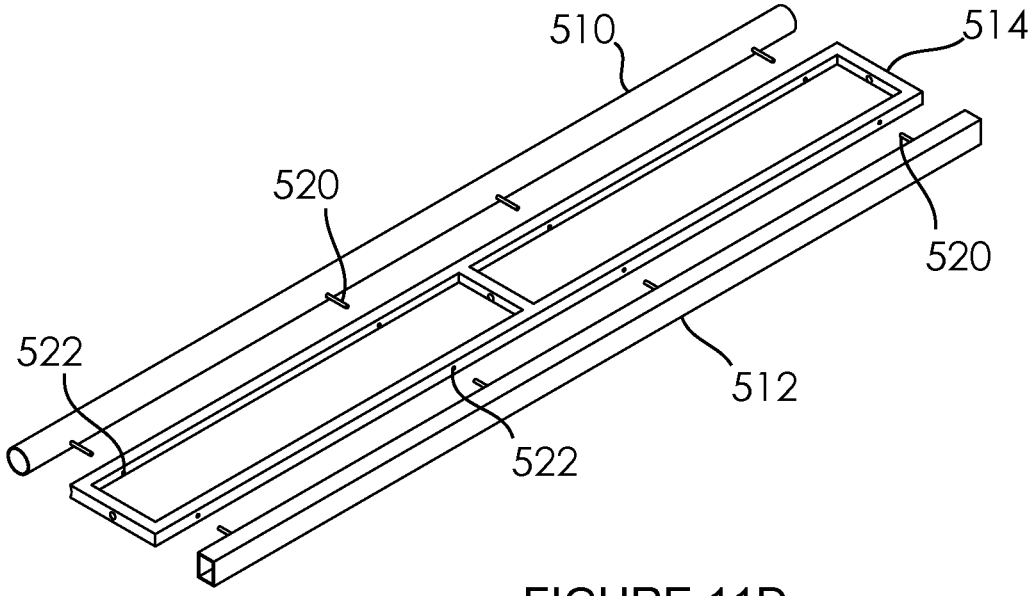

Referring to FIGS. 11A-11D, detailed diagrams of an embodiment 500 of an alternative dual rail structure are illustrated. FIG. 11A includes a top perspective view of the alternative dual rail structure 500, FIG. 11B is an exploded top perspective view of the dual rail structure 500, FIG. 11C is a bottom perspective view of the dual rail structure 500, and FIG. 11D is an exploded bottom perspective view of the dual rail structure 500.

As shown generally in FIGS. 11A-11D, the alternative dual rail structure 500 can include a first rail 510, a second rail 512, and a panel 514. In one embodiment, the alternative dual rail structure 500 can be implemented with the first embodiment support structures 104, 106 to form a transformable obstacle assembly. The alternative dual rail structure 500 can be coupled to the support structures 104, 106 in a horizontal orientation and a vertical orientation.

As shown in FIG. 11B, the rails 510, 512 can include a plurality of attachment members 520 that are adapted to connect the rails 510, 512 to the panel 514. Generally, the panel 514 can include a plurality of holes 522 adapted to receive the attachment members 520. As shown, the attachment members 520 and the holes 522 can be spaced along a length of the rails 510, 512 and the panel 514, respectively. The attachment members 520 can include, but are not limited to, a threaded rod and nut and a clevis pin. It is to be appreciated that other fastening mechanisms are contemplated for the attachment members 520.

In a typical implementation, the plurality of attachment members 520 can be directly coupled to the rails 510, 512. For instance, the attachment members 520 can be welded to the rails 510, 512. It is to be appreciated that other means of coupling the attachment members 520 to the rails 510, 512 are contemplated.

Generally, the panel 514 can be manufactured from a single stock of rigid material. For instance, the panel 514 can be machined from a single piece of aluminum. In another instance, the panel 514 can be manufactured from polyvinyl chloride or a composite wood material.

As shown in FIGS. 11A-11B, a top surface of the panel 514 can be relatively flat. A bottom of the panel 514 can generally be milled or formed with valleys allowing the attachment members 520 to be received by the plurality of holes 522, as shown in FIGS. 11C-11D. The panel 514 can include a hole 524 on each end to receive a fastener for connecting the alternative dual rail structure 500 to one or more support structures.

ALTERNATIVE EMBODIMENTS AND VARIATIONS

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention. It is to be appreciated that components of the present invention illustrated and described as being separate pieces coupled together can be machined or manufactured from a single stock of material.

We claim:

1. A transformable obstacle assembly comprising:
- a dual rail structure including:
  - a first rail;
  - a second rail coupled to the first rail;
  - a plurality of ribs adapted to couple the first rail to the second rail forming a first side and a second side; and
  - a first panel coupled to the plurality of ribs on the first side;
- at least two support structures adapted to be coupled to opposite ends of the dual rail structure, each of the support structures including:
  - a T-shaped frame; and
  - a sleeve slidably coupled to the T-shaped frame, wherein the sleeve includes:
    - a plurality of holes;
    - a horizontal flange extending out from one side of the sleeve; and
    - a pair of vertical flanges extending out from the sleeve in an opposite direction of the horizontal flange.

2. The transformable obstacle assembly of claim 1, wherein the first rail has a tubular shape.

3. The transformable obstacle assembly of claim 2, wherein the second rail has a rectangular tube shape.

4. The transformable obstacle assembly of claim 1, wherein the dual rail structure further includes a second panel coupled to the plurality of ribs on the second side.

5. The transformable obstacle assembly of claim 1, wherein the horizontal flange is adapted to interface with the dual rail structure when the dual rail structure is in a horizontal orientation.

6. The transformable obstacle assembly of claim 1, wherein the pair of vertical flanges are adapted to interface with the dual rail structure when the dual rail structure is in a vertical orientation.

7. The transformable obstacle assembly of claim 1, wherein ribs located proximate ends of the dual rail structure include at least one hole.

8. The transformable obstacle assembly of claim 1, wherein the transformable obstacle further includes a pair of rods adapted to couple the at least two support structures to the dual rail structure.

9. The transformable obstacle assembly of claim 1, wherein the dual rail structure is curved.

10. The transformable obstacle assembly of claim 9, wherein the plurality of ribs are coupled to a concave side of the first rail and to a convex side of the second rail.

11. The transformable obstacle assembly of claim 9, wherein the plurality of ribs are coupled to a side located approximately 90 degrees from a concave side of the first rail and to a side located approximately 90 degrees from a convex side of the second rail.

12. The transformable obstacle assembly of claim 1, wherein the plurality of ribs include one or more tubes.

13. The transformable obstacle assembly of claim 12, wherein the plurality of ribs further include one or more bars.

14. A transformable obstacle assembly comprising:

a dual rail structure including a first rail coupled to a second rail by a plurality of ribs;

a pair of T-shaped frames including a plurality of holes; and a pair of sleeves each slidably coupled to one of the T-shaped frames and removably coupled to opposite ends of the dual rail structure, each of the pair of sleeves comprising:

a tube having a first hole located proximate a top of the tube and a second hole located approximate a bottom portion of the tube;

a pair of flanges located on opposite sides of the tube, the pair of flanges extending out from the tube in substantially similar directions;

wherein a distance between a portion of the pair of flanges extending out from the tube is approximately equal to a width of one of the plurality of ribs located at an end of the dual rail structure.

15. The transformable obstacle assembly of claim 14, wherein the pair of flanges are adapted to interface with the dual rail structure when the dual rail structure is in a horizontal orientation and in a vertical orientation.

16. The transformable obstacle assembly of claim 14, wherein the first hole of the tube is adapted to receive a bolt.

17. The transformable obstacle assembly of claim 16, wherein the one of the plurality of ribs located at the end of the dual rail structure is adapted to threadably couple to the bolt passed through the first hole of the tube.

18. The transformable obstacle assembly of claim 14, wherein the sleeve can be coupled to the T-shaped frame by passing a fastening mechanism through the second hole of the tube and one of the plurality of holes of the T-shaped frame.

19. A transformable obstacle assembly comprising:

a dual rail structure including:

a first rail;

a second rail coupled to the first rail;

a plurality of ribs coupling the first rail to the second rail; and a pair of ribs located proximate ends of the dual rail structure, the pair of ribs each including a first attachment member;

at least two support structures adapted to be coupled to the pair of ribs located proximate ends of the dual rail structure, wherein the at least two support structures each include a second attachment member adapted to removably couple to the first attachment member of the pair of ribs;

wherein the first attachment member and the second attachment member are selected from a group consisting of a toothed hinge and a receptacle adapted to receive the toothed hinge.

20. A transformable obstacle assembly comprising:

a dual rail structure including:

a rigid panel having a first side and a second side;

a first rail coupled to the first side of the rigid panel; and a second rail coupled to the second side of the rigid panel;

two support structures coupled to opposite ends of the dual rail structure, each of the support structures including:

a T-shaped frame; and a sleeve slidably coupled to the T-shaped frame;

wherein the dual rail structure is adapted to couple to the two support structures when the dual rail structure is (i) in a horizontal orientation, and (ii) in a vertical orientation.

21. A transformable obstacle assembly comprising:

a dual rail structure including:

a first rail;

a second rail coupled to the first rail;

a plurality of ribs adapted to couple the first rail to the second rail forming a first side and a second side; and a first panel coupled to the plurality of ribs on the first side;

at least two support structures adapted to be coupled to opposite ends of the dual rail structure, each of the support structures including:

a T-shaped frame; and a sleeve slidably coupled to the T-shaped frame;

wherein the dual rail structure is adapted to couple to the two support structures when the dual rail structure is (i) in a horizontal orientation, and (ii) in a vertical orientation.

* * * * *